US010186272B2

(12) United States Patent
Liu et al.

(10) Patent No.: US 10,186,272 B2
(45) **Date of Patent: *Jan. 22, 2019**

(54) BANDWIDTH EXTENSION WITH LINE SPECTRAL FREQUENCY PARAMETERS

(71) Applicant: HUAWEI TECHNOLOGIES CO., LTD., Shenzhen, Guangdong (CN)

(72) Inventors: Zexin Liu, Beijing (CN); Lei Miao, Beijing (CN); Bin Wang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/481,306

(22) Filed: Apr. 6, 2017

(65) Prior Publication Data

US 2017/0213564 A1 Jul. 27, 2017

Related U.S. Application Data

(63) Continuation of application No. 15/068,908, filed on Mar. 14, 2016, now Pat. No. 9,666,201, which is a (Continued)

(30) Foreign Application Priority Data

Sep. 26, 2013 (CN) ..... 2013 1 0444398

(51) Int. Cl.
*G10L 21/038* (2013.01)
*G10L 19/07* (2013.01)

(Continued)

(52) U.S. Cl.
CPC ..... *G10L 19/087* (2013.01); *G10L 19/12* (2013.01); *G10L 21/038* (2013.01); *G10L 25/90* (2013.01);

(Continued)

(58) Field of Classification Search
CPC ..... G10L 19/04; G10L 19/07; G10L 19/08; G10L 19/12; G10L 21/038; G10L 21/0388

(Continued)

(56) References Cited

U.S. PATENT DOCUMENTS 5,455,888 A 10/1995 Iyengar et al.
6,199,040 B1 * 3/2001 Fette ..... G10L 19/00 704/219

(Continued)

FOREIGN PATENT DOCUMENTS

CN 1397064 A 2/2003
CN 101304261 A 11/2008

(Continued)

OTHER PUBLICATIONS

Kwon et al., "Bandwidth Extension of g.729 Speech Coder using Search-free Codebook Mapping", 2012 35th International Conference on Telecommunications and Signal Processing (TSP), Jul. 3-4, 2012, pp. 437-440. (Year: 2012).*

(Continued)

*Primary Examiner* — Martin Lerner
(74) *Attorney, Agent, or Firm* — Jinghua Karen Tang

(57) ABSTRACT

The present invention provides a bandwidth extension method and apparatus. The method includes: acquiring a bandwidth extension parameter, where the bandwidth extension parameter includes one or more of the following parameters: a linear predictive coefficient (LPC), a line spectral frequency (LSF) parameter, a pitch period, a decoding rate, an adaptive codebook contribution, and an algebraic codebook contribution; and performing, according to the bandwidth extension parameter, bandwidth extension on a decoded low frequency band signal, to obtain a high frequency band signal. The high frequency band signal (Continued)

recovered by using the bandwidth extension method and apparatus in the embodiments of the present invention is close to an original high frequency band signal, and the quality is satisfactory.

19 Claims, 8 Drawing Sheets

Related U.S. Application Data continuation of application No. PCT/CN2014/075420, filed on Apr. 15, 2014.

(51) Int. Cl.

| | |
|---|---|
| ***G10L 21/0388*** | (2013.01) |
| ***G10L 19/087*** | (2013.01) |
| ***G10L 19/12*** | (2013.01) |
| ***G10L 25/90*** | (2013.01) |
| *G10L 19/00* | (2013.01) |

(52) U.S. Cl.
CPC *G10L 2019/0002* (2013.01); *G10L 2025/906* (2013.01)

(58) Field of Classification Search
USPC ..... 704/205, 206, 208, 219, 220, 221, 225, 704/500, 501
See application file for complete search history.

(56) References Cited

U.S. PATENT DOCUMENTS

| | | | | |
|---|---|---|---|---|
| 6,675,144 | B1 | 1/2004 | Tucker et al. | |
| 7,003,454 | B2 * | 2/2006 | Ramo | G10L 19/07 704/219 |
| 7,469,206 | B2 * | 12/2008 | Kjorling | G10L 19/07 704/205 |
| 8,484,020 | B2 | 7/2013 | Krishnan et al. | |
| 9,460,734 | B2 * | 10/2016 | Tsujino | G10L 19/06 |
| 9,666,201 | B2 * | 5/2017 | Liu | G10L 21/038 |
| 2001/0044722 | A1 | 11/2001 | Gustafsson et al. | |
| 2005/0004793 | A1 | 1/2005 | Ojala et al. | |
| 2005/0149339 | A1 * | 7/2005 | Tanaka | G10L 21/038 704/500 |
| 2006/0149538 | A1 | 7/2006 | Lee et al. | |
| 2006/0277039 | A1 | 12/2006 | Vos et al. | |
| 2006/0282263 | A1 * | 12/2006 | Vos | G10L 19/0208 704/223 |
| 2007/0067163 | A1 | 3/2007 | Kabal et al. | |
| 2007/0208565 | A1 * | 9/2007 | Lakaniemi | G10L 19/008 704/268 |
| 2007/0299669 | A1 * | 12/2007 | Ehara | G10L 19/24 704/262 |
| 2008/0126086 | A1 | 5/2008 | Vos et al. | |
| 2008/0300866 | A1 | 12/2008 | Mukhtar et al. | |
| 2009/0192789 | A1 * | 7/2009 | Lee | G10L 19/0204 704/206 |
| 2009/0192792 | A1 * | 7/2009 | Lee | G10L 19/083 704/219 |
| 2011/0099004 | A1 | 4/2011 | Krishnan et al. | |
| 2011/0099018 | A1 | 4/2011 | Neuendorf et al. | |
| 2011/0202353 | A1 | 8/2011 | Neuendorf et al. | |
| 2011/0295598 | A1 | 12/2011 | Yang et al. | |
| 2012/0095758 | A1 | 4/2012 | Gibbs et al. | |
| 2012/0116769 | A1 | 5/2012 | Malah et al. | |
| 2012/0230515 | A1 | 9/2012 | Grancharov et al. | |
| 2012/0239388 | A1 | 9/2012 | Sverrisson et al. | |
| 2013/0117029 | A1 | 5/2013 | Liu et al. | |
| 2013/0226566 | A1 * | 8/2013 | Choo | G10L 19/0208 704/203 |
| 2013/0282368 | A1 | 10/2013 | Choo et al. | |
| 2013/0317812 | A1 | 11/2013 | Jeong et al. | |
| 2014/0163972 | A1 | 6/2014 | Tsujino et al. | |
| 2014/0229172 | A1 | 8/2014 | Atti et al. | |
| 2014/0233725 | A1 | 8/2014 | Kim et al. | |
| 2014/0249828 | A1 * | 9/2014 | Grancharov | G10L 19/06 704/500 |
| 2014/0257827 | A1 | 9/2014 | Norvell et al. | |
| 2014/0288925 | A1 | 9/2014 | Sverrisson et al. | |
| 2014/0372108 | A1 | 12/2014 | Choo et al. | |
| 2015/0073784 | A1 * | 3/2015 | Gao | G10L 19/0204 704/223 |
| 2015/0255080 | A1 | 9/2015 | Wang et al. | |
| 2016/0210978 | A1 * | 7/2016 | Chebiyyam | G10L 19/083 |
| 2016/0210979 | A1 | 7/2016 | Liu et al. | |

FOREIGN PATENT DOCUMENTS

| | | | |
|---|---|---|---|
| CN | 101620854 | A | 1/2010 |
| CN | 102044250 | A | 5/2011 |
| CN | 102339607 | A | 2/2012 |
| CN | 102576542 | A | 7/2012 |
| CN | 102612712 | A | 7/2012 |
| JP | 2008537165 | | 9/2008 |
| JP | 2013508783 | A | 3/2013 |
| JP | 2013511742 | A | 4/2013 |
| JP | 2013511743 | A | 4/2013 |
| WO | 0156021 | | 8/2001 |
| WO | 2013066238 | A2 | 5/2013 |

OTHER PUBLICATIONS

Deshpande et al., "A Novel BWE Scheme Based on Spectral Peaks in G.729 Compressed Domain", 2005 13th European Signal Processing Conference, Sep. 4-8, 2005, 4 Pages. (Year: 2005).*

G.729.1. G.729-based embedded variable bit-rate coder:An 8-32 kbit/s scalable wideband coder bitstream interoperable with G.729. ITU-T. May 2006. total 100 pages.

Ulrich Kornagel. Techniques for artificial bandwidth extension of telephone speech. Signal Processing, vol. 86, No. 6, Jun. 1, 2006. pp. 1296-1306.

Mcloughlin et al:"line spectral pairs", signal processing, elsevier science pulishers B. V, Amsterdam, NL, vol. 88, No. 3, Nov. 14, 2007,XP022343823. total 20 pages.

* cited by examiner

BANDWIDTH EXTENSION WITH LINE SPECTRAL FREQUENCY PARAMETERS

CROSS-REFERENCE TO RELATED APPLICATIONS

This application is a continuation of U.S. patent application Ser. No. 15/068,908, filed on Mar. 14, 2016, now U.S. Pat. No. 9,666,201 issued May 30 2017, which is a continuation of International Application No. PCT/CN2014/075420, filed on Apr. 15, 2014. The International Application claims priority to Chinese Patent Application No. 201310444398.3, filed on Sep. 26, 2013, all of aforementioned applications are hereby incorporated by reference in their entireties.

TECHNICAL FIELD

The present invention relates to the field of audio encoding and decoding, and in particular, to a bandwidth extension method and apparatus in an algebraic code excited linear prediction (ACELP) of a medium and low rate wideband.

BACKGROUND

A blind bandwidth extension technology is a technology at a decoder, and a decoder performs blind bandwidth extension according to a low frequency band decoding signal and by using a corresponding prediction method.

During ACELP encoding and decoding of a medium and low rate wideband, existing algorithms all first down-sample a wideband signal sampled at 16 kHz to 12.8 kHz, and then perform encoding. In this way, bandwidth of a signal output after the encoding and decoding is only 6.4 kHz. If an original algorithm is not changed, information in a part with a bandwidth of 6.4 to 8 kHz or 6.4 to 7 kHz needs to be recovered in a manner of the blind bandwidth extension, that is, corresponding recovery is performed only at the decoder.

However, a high frequency band signal recovered by the existing blind bandwidth extension technology deviates much from an original high frequency band signal, causing that the recovered high frequency band signal is unsatisfactory.

SUMMARY

The present invention provides a bandwidth extension method and apparatus, and aims at solving a problem that a high frequency band signal recovered by using an existing blind bandwidth extension technology deviates much from an original high frequency band signal.

According to a first aspect, a bandwidth extension method is provided, including: acquiring a bandwidth extension parameter, where the bandwidth extension parameter includes one or more of the following parameters: a linear predictive coefficient (LPC), a line spectral frequency (LSF) parameter, a pitch period, a decoding rate, an adaptive codebook contribution, and an algebraic codebook contribution; and performing, according to the bandwidth extension parameter, bandwidth extension on a decoded low frequency band signal, to obtain a high frequency band signal.

With reference to the first aspect, in a first implementation manner of the first aspect, the performing, according to the bandwidth extension parameter, bandwidth extension on a decoded low frequency band signal, to obtain a high frequency band signal includes: predicting high frequency band energy and a high frequency band excitation signal according to the bandwidth extension parameter; and obtaining the high frequency band signal according to the high frequency band energy and the high frequency band excitation signal.

With reference to the first implementation manner of the first aspect, in a second implementation manner of the first aspect, the high frequency band energy includes a high frequency band gain; and the predicting high frequency band energy and a high frequency band excitation signal according to the bandwidth extension parameter includes: predicting the high frequency band gain according to the LPC; and adaptively predicting the high frequency band excitation signal according to the LSF parameter, the adaptive codebook contribution, and the algebraic codebook contribution.

With reference to the second implementation manner of the first aspect, in a third implementation manner of the first aspect, the adaptively predicting the high frequency band excitation signal according to the LSF parameter, the adaptive codebook contribution, and the algebraic codebook contribution includes: adaptively predicting the high frequency band excitation signal according to the decoding rate, the LSF parameter, the adaptive codebook contribution, and the algebraic codebook contribution.

With reference to the first implementation manner of the first aspect, in a fourth implementation manner of the first aspect, the high frequency band energy includes a high frequency band gain; and the predicting high frequency band energy and a high frequency band excitation signal according to the bandwidth extension parameter includes: predicting the high frequency band gain according to the LPC; and adaptively predicting the high frequency band excitation signal according to the adaptive codebook contribution and the algebraic codebook contribution.

With reference to the fourth implementation manner of the first aspect, in a fifth implementation manner of the first aspect, the adaptively predicting the high frequency band excitation signal according to the adaptive codebook contribution and the algebraic codebook contribution includes: adaptively predicting the high frequency band excitation signal according to the decoding rate, the adaptive codebook contribution, and the algebraic codebook contribution.

With reference to the first implementation manner of the first aspect, in a sixth implementation manner of the first aspect, the high frequency band energy includes a high frequency band envelope; and the predicting high frequency band energy and a high frequency band excitation signal according to the bandwidth extension parameter includes: predicting the high frequency band envelope according to the decoded low frequency band signal or a low frequency band excitation signal, where the low frequency band excitation signal is the sum of the adaptive codebook contribution and the algebraic codebook contribution; and predicting the high frequency band excitation signal according to the decoded low frequency band signal or the low frequency band excitation signal.

With reference to the sixth implementation manner of the first aspect, in a seventh implementation manner of the first aspect, the predicting the high frequency band excitation signal according to the decoded low frequency band signal or the low frequency band excitation signal includes: predicting the high frequency band excitation signal according to the decoding rate and the decoded low frequency band signal.

With reference to the sixth implementation manner of the first aspect, in an eighth implementation manner of the first aspect, the predicting the high frequency band excitation signal according to the decoded low frequency band signal or a low frequency band excitation signal includes: predicting the high frequency band excitation signal according to the decoding rate and the low frequency band excitation signal.

With reference to the first to the eighth implementation manners of the first aspect, in a ninth implementation manner of the first aspect, after the predicting a high frequency band energy and a high frequency band excitation signal according to the bandwidth extension parameter, the method further includes: determining a first correction factor according to at least one of the bandwidth extension parameter and the decoded low frequency band signal, where the first correction factor includes one or more of the following parameters: a voicing factor, a noise gate factor, and a spectrum tilt factor; and correcting the high frequency band energy according to the first correction factor.

With reference to the ninth implementation manner of the first aspect, in a tenth implementation manner of the first aspect, the determining a first correction factor according to at least one of the bandwidth extension parameter and the decoded low frequency band signal includes: determining the first correction factor according to the pitch period, the adaptive codebook contribution, the algebraic codebook contribution, and the decoded low frequency band signal.

With reference to the ninth implementation manner of the first aspect, in an eleventh implementation manner of the first aspect, the determining a first correction factor according to at least one of the bandwidth extension parameter and the decoded low frequency band signal includes: determining the first correction factor according to the decoded low frequency band signal.

With reference to the ninth implementation manner of the first aspect, in a twelfth implementation manner of the first aspect, the determining a first correction factor according to at least one of the bandwidth extension parameter and the decoded low frequency band signal includes: determining the first correction factor according to the pitch period, the adaptive codebook contribution, the algebraic codebook contribution, and the decoded low frequency band signal.

With reference to the ninth to the twelfth implementation manners of the first aspect, in a thirteenth implementation manner of the first aspect, the method further includes: correcting the high frequency band energy according to the pitch period.

With reference to the ninth to the thirteenth implementation manners of the first aspect, in a fourteenth implementation manner of the first aspect, the method further includes: determining a second correction factor according to at least one of the bandwidth extension parameter and the decoded low frequency band signal, where the second correction factor includes at least one of a classification parameter and a signal type; and correcting the high frequency band energy and the high frequency band excitation signal according to the second correction factor.

With reference to the fourteenth implementation manner of the first aspect, in a fifteenth implementation manner of the first aspect, the determining a second correction factor according to at least one of the bandwidth extension parameter and the decoded low frequency band signal includes: determining the second correction factor according to the bandwidth extension parameter.

With reference to the fourteenth implementation manner of the first aspect, in a sixteenth implementation manner of the first aspect, the determining a second correction factor according to at least one of the bandwidth extension parameter and the decoded low frequency band signal includes: determining the second correction factor according to the decoded low frequency band signal.

With reference to the fourteenth implementation manner of the first aspect, in a seventeenth implementation manner of the first aspect, the determining a second correction factor according to at least one of the bandwidth extension parameter and the decoded low frequency band signal includes: determining the second correction factor according to the bandwidth extension parameter and the decoded low frequency band signal.

With reference to the ninth to the seventeenth implementation manners of the first aspect, in an eighteenth implementation manner of the first aspect, the method further includes: weighting the predicted high frequency band excitation signal and a random noise signal, to obtain a final high frequency band excitation signal, where a weight of the weighting is determined according to a value of a classification parameter and/or a voicing factor of the decoded low frequency band signal.

With reference to the first to the eighteenth implementation manners of the first aspect, in a nineteenth implementation manner of the first aspect, the obtaining the high frequency band signal according to the high frequency band energy and the high frequency band excitation signal includes: synthesizing the high frequency band energy and the high frequency band excitation signal, to obtain the high frequency band signal; or synthesizing the high frequency band energy, the high frequency band excitation signal, and a predicted LPC, to obtain the high frequency band signal, where the predicted LPC includes a predicted high frequency band LPC or a predicted wideband LPC, and the predicted LPC is obtained based on the LPC.

According to a second aspect, a bandwidth extension apparatus is provided, including: an acquisition unit, configured to acquire a bandwidth extension parameter, where the bandwidth extension parameter includes one or more of the following parameters: a linear predictive coefficient (LPC), a line spectral frequency (LSF) parameter, a pitch period, a decoding rate, an adaptive codebook contribution, and an algebraic codebook contribution; and a bandwidth extension unit, configured to perform, according to the bandwidth extension parameter acquired by the acquisition unit, bandwidth extension on a decoded low frequency band signal, to obtain a high frequency band signal.

With reference to the second aspect, in a first implementation manner of the second aspect, the bandwidth extension unit includes: a prediction subunit, configured to predict high frequency band energy and a high frequency band excitation signal according to the bandwidth extension parameter; and a synthesis subunit, configured to obtain the high frequency band signal according to the high frequency band energy and the high frequency band excitation signal.

With reference to the first implementation manner of the second aspect, in a second implementation manner of the second aspect, the high frequency band energy includes a high frequency band gain; and the prediction subunit is specifically configured to: predict the high frequency band gain according to the LPC; and adaptively predict the high frequency band excitation signal according to the LSF parameter, the adaptive codebook contribution, and the algebraic codebook contribution.

With reference to the first implementation manner of the second aspect, in a third implementation manner of the second aspect, the high frequency band energy includes a high frequency band gain; and the prediction subunit is specifically configured to: predict the high frequency band gain according to the LPC; and adaptively predict the high frequency band excitation signal according to the decoding rate, the LSF parameter, the adaptive codebook contribution, and the algebraic codebook contribution.

With reference to the first implementation manner of the second aspect, in a fourth implementation manner of the second aspect, the high frequency band energy includes a high frequency band gain; and the prediction subunit is specifically configured to: predict the high frequency band gain according to the LPC; and adaptively predict the high frequency band excitation signal according to the adaptive codebook contribution and the algebraic codebook contribution.

With reference to the first implementation manner of the second aspect, in a fifth implementation manner of the second aspect, the high frequency band energy includes a high frequency band gain; and the prediction subunit is specifically configured to: predict the high frequency band gain according to the LPC; and adaptively predict the high frequency band excitation signal according to the decoding rate, the adaptive codebook contribution, and the algebraic codebook contribution.

With reference to the first implementation manner of the second aspect, in a sixth implementation manner of the second aspect, the high frequency band energy includes a high frequency band envelope; and the prediction subunit is specifically configured to: predict the high frequency band envelope according to the decoded low frequency band signal; and predict the high frequency band excitation signal according to the decoded low frequency band signal or a low frequency band excitation signal, where the low frequency band excitation signal is the sum of the adaptive codebook contribution and the algebraic codebook contribution.

With reference to the sixth implementation manner of the second aspect, in a seventh implementation manner of the second aspect, the prediction subunit is specifically configured to:

predict the high frequency band envelope according to the decoded low frequency band signal; and predict the high frequency band excitation signal according to the decoding rate and the low frequency band excitation signal.

With reference to the sixth implementation manner of the second aspect, in an eighth implementation manner of the second aspect, the prediction subunit is specifically configured to: predict the high frequency band envelope according to the decoded low frequency band signal; and predict the high frequency band excitation signal according to the decoding rate and the decoded low frequency band signal.

With reference to the first to the eighth implementation manners of the second aspect, in a ninth implementation manner of the second aspect, the bandwidth extension unit further includes: a first correction subunit, configured to: after the high frequency band energy and the high frequency band excitation signal are predicted according to the bandwidth extension parameter, determine a first correction factor according to at least one of the bandwidth extension parameter and the decoded low frequency band signal, where the first correction factor includes one or more of the following parameters: a voicing factor, a noise gate factor, and a spectrum tilt factor; and correct the high frequency band energy according to the first correction factor.

With reference to the ninth implementation manner of the second aspect, in a tenth implementation manner of the second aspect, the first correction subunit is specifically configured to: determine the first correction factor according to the pitch period, the adaptive codebook contribution, and the algebraic codebook contribution; and correct the high frequency band energy according to the first correction factor.

With reference to the ninth implementation manner of the second aspect, in an eleventh implementation manner of the second aspect, the first correction subunit is specifically configured to: determine the first correction factor according to the decoded low frequency band signal; and correct the high frequency band energy according to the first correction factor.

With reference to the ninth implementation manner of the second aspect, in a twelfth implementation manner of the second aspect, the first correction subunit is specifically configured to: determine the first correction factor according to the pitch period, the adaptive codebook contribution, the algebraic codebook contribution, and the decoded low frequency band signal; and correct the high frequency band energy according to the first correction factor.

With reference to the ninth to the twelfth implementation manners of the second aspect, in a thirteenth implementation manner of the second aspect, the bandwidth extension unit further includes: a second correction subunit, configured to correct the high frequency band energy according to the pitch period.

With reference to the ninth to the thirteenth implementation manners of the second aspect, in a fourteenth implementation manner of the second aspect, the bandwidth extension unit further includes: a third correction subunit, configured to determine a second correction factor according to at least one of the bandwidth extension parameter and the decoded low frequency band signal, where the second correction factor includes at least one of a classification parameter and a signal type; and correct the high frequency band energy and the high frequency band excitation signal according to the second correction factor.

With reference to the fourteenth implementation manner of the second aspect, in a fifteenth implementation manner of the second aspect, the third correction subunit is specifically configured to determine the second correction factor according to the bandwidth extension parameter; and correct the high frequency band energy and the high frequency band excitation signal according to the second correction factor.

With reference to the fourteenth implementation manner of the second aspect, in a sixteenth implementation manner of the second aspect, the third correction subunit is specifically configured to determine the second correction factor according to the decoded low frequency band signal; and correct the high frequency band energy and the high frequency band excitation signal according to the second correction factor.

With reference to the fourteenth implementation manner of the second aspect, in a seventeenth implementation manner of the second aspect, the third correction subunit is specifically configured to determine the second correction factor according to the bandwidth extension parameter and the decoded low frequency band signal; and correct the high frequency band energy and the high frequency band excitation signal according to the second correction factor.

With reference to the ninth to the seventeenth implementation manners of the second aspect, in an eighteenth implementation manner of the second aspect, the bandwidth extension unit further includes: a weighting subunit, configured to weight the predicted high frequency band excitation signal and a random noise signal, to obtain a final high frequency band excitation signal, where a weight of the weighting is determined according to a value of a classification parameter and/or a voicing factor of the decoded low frequency band signal.

With reference to the first to the eighteenth implementation manners of the second aspect, in a nineteenth implementation manner of the second aspect, the synthesis subunit is specifically configured to: synthesize the high frequency band energy and the high frequency band excitation signal, to obtain the high frequency band signal; or synthesize the high frequency band energy, the high frequency band excitation signal, and a predicted LPC, to obtain the high frequency band signal, where the predicted LPC includes a predicted high frequency band LPC or a predicted wideband LPC, and the predicted LPC is obtained based on the LPC.

In the embodiments of the present invention, bandwidth extension is performed, by using a bandwidth extension parameter and by using the bandwidth extension parameter, on a decoded low frequency band signal, thereby recovering a high frequency band signal. The high frequency band signal recovered by using the bandwidth extension method and apparatus in the embodiments of the present invention is close to an original high frequency band signal, and the quality is satisfactory.

BRIEF DESCRIPTION OF DRAWINGS

To describe the technical solutions in the embodiments of the present invention more clearly, the following briefly introduces the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

In the embodiments of the present invention, bandwidth extension is performed on a low frequency band signal according to any one of or a combination of some of a decoding rate, an LPC coefficient (an LSF parameter) and a pitch period that are obtained by directly decoding a bitstream, an adaptive codebook contribution and an algebraic codebook contribution that are obtained by intermediate decoding, and a low frequency band signal obtained by final decoding, thereby recovering a high frequency band signal.

Figure 1:
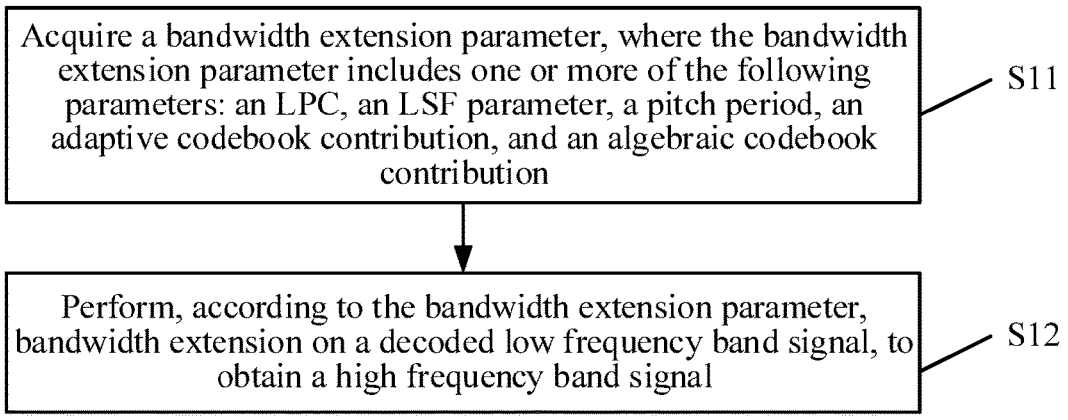
FIG. 1 is a flowchart of a bandwidth extension method according to an embodiment of the present invention.

The following describes in detail a bandwidth extension method according to an embodiment of the present invention with reference to FIG. 1, which may include the following steps.

S11: A decoder acquires a bandwidth extension parameter, where the bandwidth extension parameter includes one or more of the following parameters: a linear predictive coefficient (LPC, Linear Predictive coefficient), line spectral frequencies (LSF, Linear Spectral Frequencies) parameter, a pitch period, an adaptive codebook contribution, and an algebraic codebook contribution.

The decoder may be disposed in a hardware device such as a mobile phone, a tablet, a computer, a television set, a set top box, or a gaming console on which a decoding operation needs to be performed, and work under the control of processors in these hardware devices. The decoder may also be an independent hardware device, where the hardware device includes a processor, and the hardware device works under the control of the processor.

Specifically, the LPC is a coefficient of a linear prediction filter, and the linear prediction filter can describe a basic feature of a sound channel model, and the LPC also reflects an energy change trend of a signal in a frequency domain. The LSF parameter is a representation manner of the frequency domain of the LPC.

In addition, when a person produces a voiced sound, an airflow passes through a glottis, and makes vocal cords produce a relaxation oscillatory vibration, thereby creating a quasi-periodic pulse airflow. This airflow excites a sound channel and then the voiced sound is produced, which is also referred to as a voiced speech. The voiced speech carries most energy in a speech. Such a frequency at which the vocal cords vibrate is referred to as a fundamental frequency, and a corresponding period is referred to as the pitch period.

The decoding rate refers to that, in a speech encoding algorithm, encoding and decoding are both processed according to a rate (a bit rate) that is set in advance, and for different decoding rates, processing manners or parameters may be different.

The adaptive codebook contribution is a quasi-periodic portion in a residual signal after a speech signal is analyzed by using the LPC. The algebraic codebook contribution refers to a quasi-noise portion in the residual signal after the speech signal is analyzed by using the LPC.

Herein, the LPC and the LSF parameter may be obtained by directly decoding the bitstream; the adaptive codebook contribution and the algebraic codebook contribution may be combined to obtain a low frequency band excitation signal.

The adaptive codebook contribution reflects a quasi-periodic constituent of the signal, and the algebraic codebook contribution reflects a quasi-noise constituent of the signal.

S12: The decoder performs, according to the bandwidth extension parameter, bandwidth extension on a decoded low frequency band signal, to obtain a high frequency band signal.

For example, first, high frequency band energy and a high frequency band excitation signal are predicted according to the bandwidth extension parameter, where the high frequency band energy may include a high frequency band envelope or a high frequency band gain; then, the high frequency band signal is obtained according to the high frequency band energy and the high frequency band excitation signal.

Further, for a difference between a time domain and a frequency domain, the bandwidth extension parameter involved in the prediction of the high frequency band energy or the high frequency band excitation signal may be different.

If the bandwidth extension is performed in the time domain and the frequency domain, the predicting high frequency band energy and a high frequency band excitation signal according to the bandwidth extension parameter may include: predicting the high frequency band gain according to the LPC; and adaptively predicting the high frequency band excitation signal according to the LSF parameter, the adaptive codebook contribution and the algebraic codebook contribution. Further, the high frequency band excitation signal may be further adaptively predicted according to the decoding rate, the LSF parameter, the adaptive codebook contribution, and the algebraic codebook contribution.

Optionally, if the bandwidth extension is performed in the time domain, the predicting high frequency band energy and a high frequency band excitation signal according to the bandwidth extension parameter may include: predicting the high frequency band gain according to the LPC; and adaptively predicting the high frequency band excitation signal according to the adaptive codebook contribution and the algebraic codebook contribution. Further, the high frequency band excitation signal may be further adaptively predicted according to the decoding rate, the adaptive codebook contribution, and the algebraic codebook contribution.

Optionally, if the bandwidth extension is performed in the frequency domain, the predicting high frequency band energy and a high frequency band excitation signal according to the bandwidth extension parameter may include: predicting the high frequency band envelope according to the decoded low frequency band signal; and predicting the high frequency band excitation signal according to the decoded low frequency band signal or a low frequency band excitation signal. Herein, the low frequency band excitation signal is the sum of the adaptive codebook contribution and the algebraic codebook contribution. Further, the high frequency band excitation signal may also be predicted according to the decoding rate and the decoded low frequency band signal; or the high frequency band excitation signal may also be predicted according to the decoding rate and the low frequency band excitation signal.

In addition, after the predicting high frequency band energy and a high frequency band excitation signal according to the bandwidth extension parameter, the bandwidth extension method in this embodiment of the present invention may further include: determining a first correction factor according to at least one of the bandwidth extension parameter and the decoded low frequency band signal, where the first correction factor includes one or more of the following parameters: a voicing factor, a noise gate factor, and a spectrum tilt factor; and correcting the high frequency band energy according to the first correction factor. For example, the voicing factor or the noise gate factor may be determined according to the bandwidth extension parameter, and the spectrum tilt factor may be determined according to the decoded low frequency band signal.

The determining a first correction factor according to the bandwidth extension parameter and the decoded low frequency band signal may include: determining the first correction factor according to the decoded low frequency band signal; or, determining the first correction factor according to the pitch period, the adaptive codebook contribution, and the algebraic codebook contribution; or, determining the first correction factor according to the pitch period, the adaptive codebook contribution, the algebraic codebook contribution, and the decoded low frequency band signal.

In addition, the bandwidth extension method in this embodiment of the present invention may further include: correcting the high frequency band energy according to the pitch period.

In addition, the bandwidth extension method in this embodiment of the present invention may further include: determining a second correction factor according to at least one of the bandwidth extension parameter and the decoded low frequency band signal, where the second correction factor includes at least one of a classification parameter and a signal type; and correcting the high frequency band energy and the high frequency band excitation signal according to the second correction factor.

Specifically, the determining a second correction factor according to at least one of the bandwidth extension parameter and the decoded low frequency band signal may include: determining the second correction factor according to the bandwidth extension parameter; or, determining the second correction factor according to the decoded low frequency band signal; or, determining the second correction factor according to the bandwidth extension parameter and the decoded low frequency band signal.

In addition, the bandwidth extension method in this embodiment of the present invention may further include: correcting the high frequency band excitation signal according to a random noise signal and the decoding rate.

Moreover, the obtaining the high frequency band signal according to the high frequency band energy and the high frequency band excitation signal may include: synthesizing the high frequency band energy and the high frequency band excitation signal, to obtain the high frequency band signal; or synthesizing the high frequency band energy, the high frequency band excitation signal, and a predicted LPC, to obtain the high frequency band signal, where the predicted LPC includes a predicted high frequency band LPC or a predicted wideband LPC, and the predicted LPC is obtained based on the LPC. The "wideband" in the wideband LPC herein includes a low frequency band and a high frequency band.

It can be seen from the above that, in this embodiment of the present invention, bandwidth extension is performed, by using a bandwidth extension parameter, on a decoded low frequency band signal, thereby recovering a high frequency band signal. The high frequency band signal recovered by using the bandwidth extension method in this embodiment of the present invention is close to an original high frequency band signal, and the quality is satisfactory.

That is, in the bandwidth extension method in this embodiment of the present invention, high frequency band energy is predicted by fully using a low frequency band parameter obtained by directly decoding a bitstream, an intermediate decoded parameter, or the low frequency band signal obtained by final decoding; a high frequency band excitation signal is adaptively predicted according to a low frequency band excitation signal, so that the high frequency band signal that is finally output is closer to the original high frequency band signal, thereby improving quality of the output signal.

The following describes specific embodiments of the present invention in detail with reference to accompanying drawings.

Figure 2:
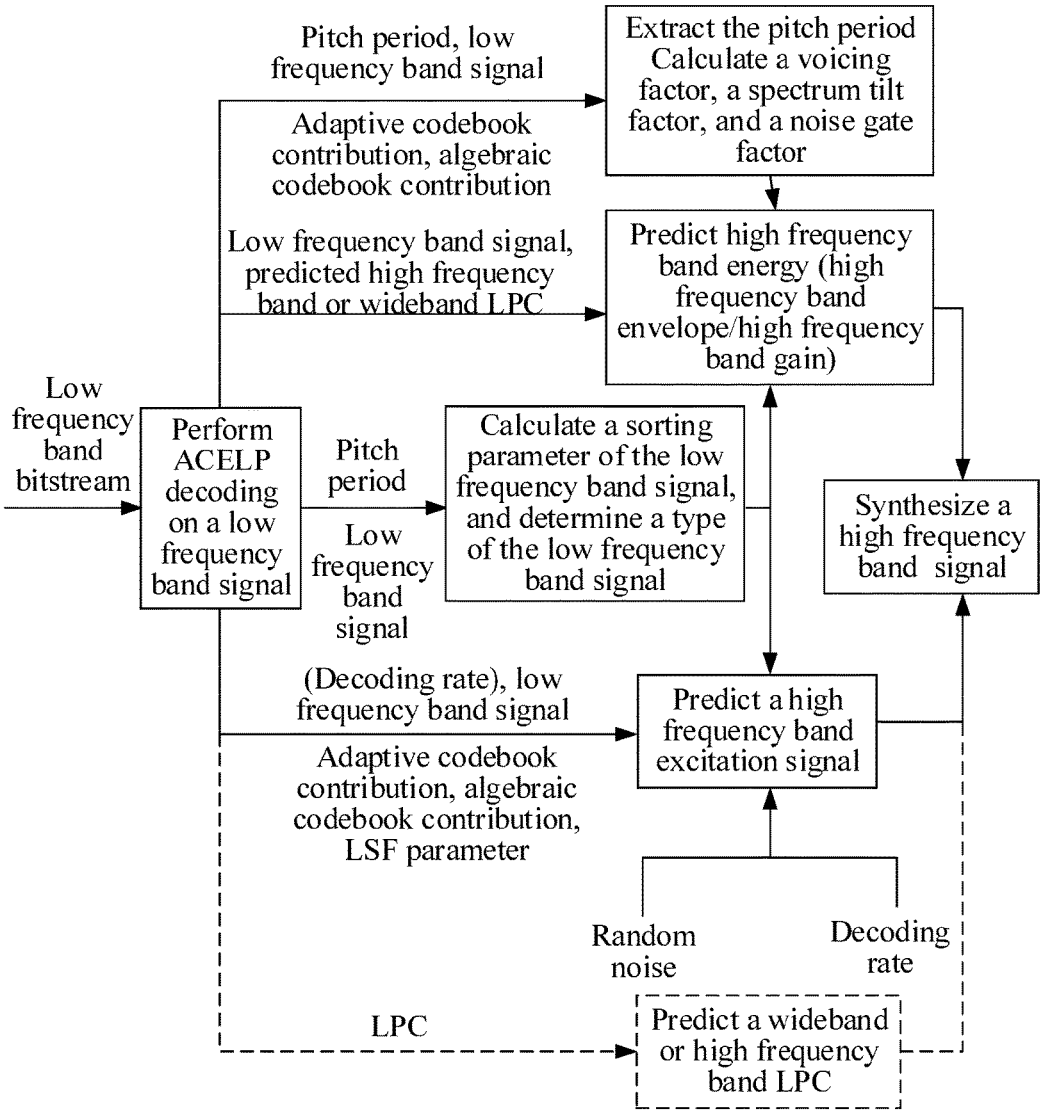
FIG. 2 is a block diagram of an implementation of a bandwidth extension method according to an embodiment of the present invention.

First, FIG. 2 shows a schematic flowchart of a bandwidth extension method according to a specific embodiment of the present invention.

As shown in FIG. 2, first, any one of or a combination of some of a voicing factor, a noise gate factor, a spectrum tilt factor, and a value of a classification parameter is calculated according to any one of or a combination of some of a decoding rate, an LPC (or an LSF parameter) and a pitch period that are obtained by directly decoding a bitstream, parameters such as an adaptive codebook contribution and an algebraic codebook contribution that are obtained by intermediate decoding, and a low frequency band signal obtained by final decoding. The voicing factor is a ratio of the adaptive codebook contribution to the algebraic codebook contribution, the noise gate factor is a parameter used to represent magnitude of a signal background noise, and the spectrum tilt factor is used to represent a degree of signal spectrum tilt or an energy change trend of a signal between different frequency bands, where the classification parameter is a parameter used to differentiate signal types. Then, a high frequency band LPC or a wideband LPC, high frequency band energy (for example, a high frequency band gain, or a high frequency band envelope), and a high frequency band excitation signal are predicted. Finally, a high frequency band signal is synthesized by using the predicted high frequency band energy and high frequency band excitation signal, or by using the predicted high frequency band energy and high frequency band excitation signal, and the predicted LPC.

Specifically, the high frequency band LPC or the wideband LPC may be predicted according to the LPC obtained by decoding.

The high frequency band envelope or the high frequency band gain may be predicted in the following manner:

For example, the high frequency band gain or the high frequency band envelope is predicted by using the predicted LPC and the LPC obtained by decoding, or a relationship between high and low frequency band of the decoded low frequency band signal.

Alternatively, for example, for different signal types, different correction factors are calculated to correct the predicted high frequency band gain or high frequency band envelope. For example, the predicted high frequency band envelope or high frequency band gain may be corrected by using a weighted value or weighted values of any one or some of the classification parameter, the spectrum tilt factor, the voicing factor, and the noise gate factor of the decoded low frequency band signal. Alternatively, for a signal whose pitch period is stable, the predicted high frequency band envelope may be further corrected by using the pitch period.

The high frequency band excitation signal may be predicted in the following manner:

For example, for different decoding rates or different types of signals, high frequency band excitation signals are predicted by adaptively selecting low frequency band signals with different frequency bands and obtained by decoding, or by using different prediction algorithms.

Further, the predicted high frequency band excitation signal and a random noise signal are weighted, to obtain a final high frequency band excitation signal, where a weight is determined according to the value of the classification parameter and/or the voicing factor of the decoded low frequency band signal.

Finally, the high frequency band signal is synthesized by using the predicted high frequency band energy and high frequency band excitation signal, or by using the predicted high frequency band energy and high frequency band excitation signal, and the predicted LPC.

It can be seen from the above that, in the bandwidth extension method in this embodiment of the present invention, high frequency band energy is predicted by fully using a low frequency band parameter obtained by directly decoding a bitstream, an intermediate decoded parameter, or a low frequency band signal obtained by final decoding; a high frequency band excitation signal is adaptively predicted according to a low frequency band excitation signal, so that a high frequency band signal that is finally output is closer to an original high frequency band signal, thereby improving quality of the output signal.

For a difference between a time domain and a frequency domain, a specific implementation process of the bandwidth extension method in this embodiment of the present invention may vary. The following separately describes specific embodiments for the time domain and the frequency domain, for the frequency domain, and for the time domain with reference to FIG. 3 to FIG. 5.

Figure 3:
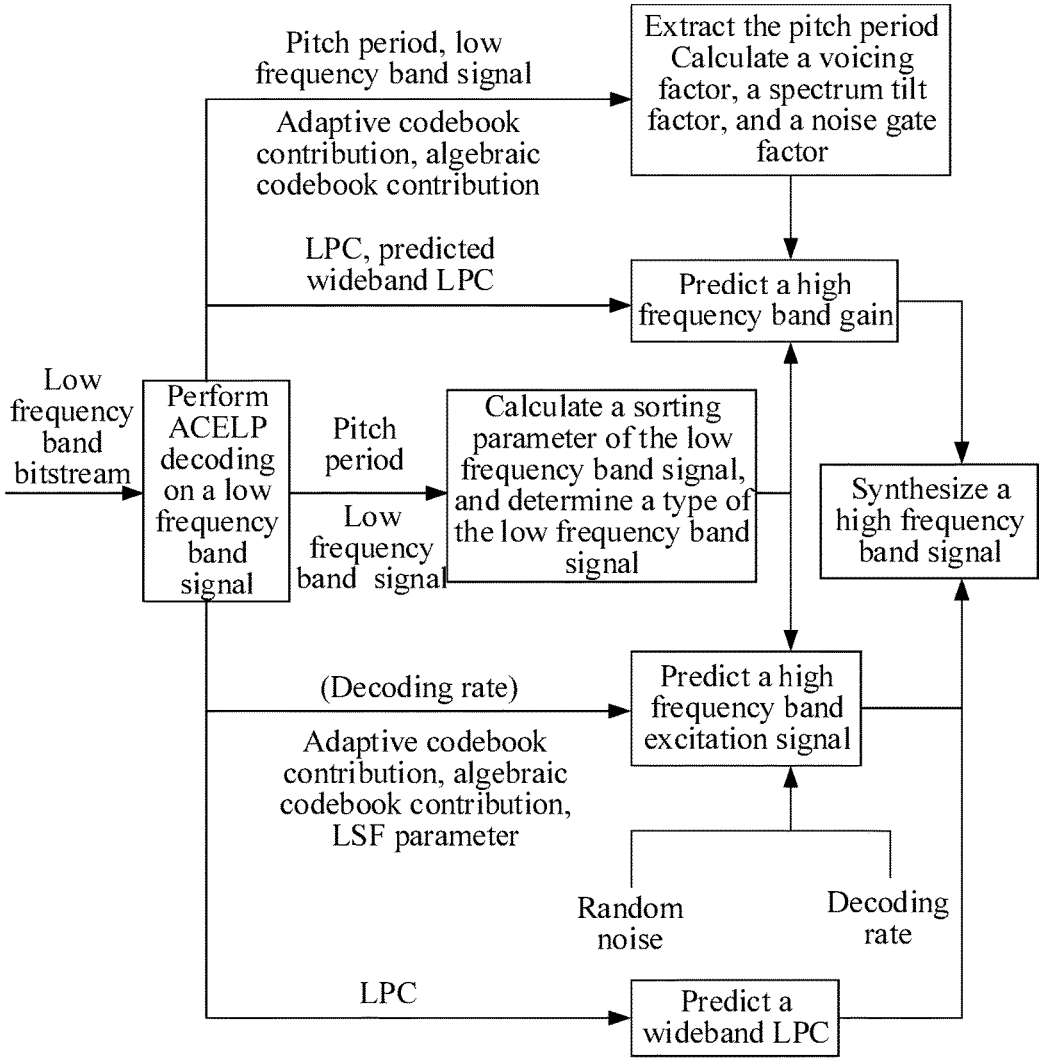
FIG. 3 is a block diagram of an implementation of a bandwidth extension method in a time domain and a frequency domain according to an embodiment of the present invention.

As shown in FIG. 3, in a specific implementation process of performing bandwidth extension in a time domain and a frequency domain:

First, a wideband LPC is predicted according to an LPC obtained by decoding.

Then, a high frequency band gain is predicted by using a relationship between the predicted wideband LPC and the LPC obtained by decoding. Moreover, for different signal types, different correction factors are calculated to correct the predicted high frequency band gain. For example, the predicted high frequency band gain is corrected by using a classification parameter, a spectrum tilt factor, a voicing factor, and a noise gate factor of a decoded low frequency band signal. A corrected high frequency band gain is proportional to a minimum noise gate factor ng_min, proportional to a value fmerit of the classification parameter, proportional to an opposite number of the spectrum tilt factor tilt, and inversely proportional to the voicing factor voice_fac. In this case, a larger high frequency band gain indicates a smaller spectrum tilt factor; a louder background noise indicates a larger noise gate factor; a stronger speech characteristic indicates a larger value of the classification parameter. For example, the corrected high frequency band gain=gain*(1−tilt)*fmerit*(30+ng_min)*(1.6−voice_fac). Herein, a noise gate factor evaluated in each frame needs to be compared with a given threshold; therefore, when the noise gate factor evaluated in each frame is less than the given threshold, the minimum noise gate factor is equal to the noise gate factor evaluated in each frame; otherwise, the minimum noise gate factor is equal to the given threshold.

Moreover, for different decoding rates or different types of signals, high frequency band excitation signals are predicted by adaptively selecting low frequency band signals with different frequency bands and obtained by decoding, or by using different prediction algorithms. For example, when a decoding rate is greater than a given value, a low frequency band excitation signal (the sum of the adaptive codebook contribution and the algebraic codebook contribution) with a frequency band adjacent to the high frequency band signal is used as the high frequency band excitation signal; otherwise, a signal with a frequency band whose encoding quality is better (that is, a difference value between LSF parameters is smaller) is adaptively selected from low frequency band excitation signals as the high frequency band excitation signal by using the difference value between the LSF parameters. It may be understood that, different decoders may select different given values. For example, an adaptive multi-rate wideband (AMR-WB) codec supports decoding rates such as 12.65 kbps, 15.85 kbps, 18.25 kbps, 19.85 kbps, 23.05 kbps, and 23.85 kbps, and then the AMR-WB codec may select 19.85 kbps as the given value.

An ISF parameter (the ISF parameter is a group of numbers, and is the same as an order of an LPC coefficient) is a representation manner of a frequency domain of the LPC coefficient, and reflects an energy change of a speech/audio signal in the frequency domain. A value of the ISF roughly corresponds to an entire frequency band from a low frequency to a high frequency of the speech/audio signal, and each value of the ISF parameter corresponds to one corresponding frequency value.

In an embodiment of the present invention, that a signal with a frequency band whose encoding quality is better (that is, a difference value between LSF parameters is smaller) is adaptively selected from low frequency band excitation signals as the high frequency band excitation signal by using the difference value between the LSF parameters may include: a difference value between each two LSF parameters is calculated, to obtain a group of difference values of the LSF parameters; a minimum difference value is searched for, and a frequency bin corresponding to the LSF parameter is determined according to the minimum difference value; and a frequency domain excitation signal with a frequency band is selected from frequency domain excitation signals according to the frequency bin, and is used as an excitation signal with a high frequency band. There are multiple selection manners. If the frequency bin is F1, a signal with a frequency band of a needed length may be selected from a frequency bin F1-F, and is used as the high frequency band excitation signal, where F>=0, and the specifically selected length is determined according to bandwidth and a signal feature of a high frequency band signal that need to be recovered.

In addition, when the frequency band whose encoding quality is better is adaptively selected from the low frequency band excitation signals, for a music signal or a speech signal, a different minimum start selection frequency bin is selected. For example, for the speech signal, the selection may be performed adaptively from a range of 2 to 6 kHz; for the music signal, the selection may be performed adaptively from a range of 1 to 6 kHz. The predicted high frequency band excitation signal and a random noise signal may be further weighted, to obtain a final high frequency band excitation signal, where a weight of the weighting is determined according to the value of the classification parameter and/or the voicing factor of the low frequency band signal:

$$\mathrm{exc}[n]=\alpha*\mathrm{exc}[n]+\beta*\mathrm{random}[n],\ \text{where}\ \alpha=\sqrt{\gamma*\mathrm{fmerit}*(1-\mathrm{voice_fac})},\ \beta=1-\alpha$$

where exc[n] is the predicted high frequency band excitation signal, random[n] is the random noise signal, $\alpha$ is a weight of the predicted high frequency band excitation signal, $\beta$ is a weight of the random noise signal, $\gamma$ is a value that is preset when the weight of the predicted high frequency band excitation signal is calculated to be $\alpha$, fmerit is the value of the classification parameter, and voice_fac is the voicing factor.

It is easy to understand that, signal classification methods are different, and therefore high frequency band excitation signals are predicted by adaptively selecting low frequency band signals with different frequency bands and obtained by decoding or by using different prediction algorithms. For example, signals may be classified into speech signals and music signals, where the speech signals may be further classified into unvoiced sounds, voiced sounds, and transition sounds. Alternatively, the signals may be further classified into transient signals and non-transient signals, and so on.

Finally, the high frequency band signal is synthesized by using the predicted high frequency band gain and high frequency band excitation signal, and the predicted LPC. The high frequency band excitation signal is corrected by using the predicted high frequency band gain, and then a corrected high frequency band excitation signal passes through an LPC synthesis filter, to obtain a high frequency band signal that is finally output; or the high frequency band excitation signal passes through an LPC synthesis filter, to obtain a high frequency band signal, and then the high frequency band signal is corrected by using the high frequency band gain, to obtain a high frequency band signal that is finally output. The LPC synthesis filter is a linear filter, and therefore a correction before the synthesis is the same as a correction after the synthesis. That is, a result of correcting the high frequency band excitation signal before the synthesis by using the high frequency band gain is the same as a result of correcting the high frequency band excitation signal after the synthesis by using the high frequency band gain, and therefore there is no sequential order for correction.

Herein, in a synthesis process, the obtained high frequency band excitation signal of the frequency domain is converted into the high frequency band excitation signal of the time domain, the high frequency band excitation signal of the time domain and the high frequency band gain of the time domain are used as inputs of the synthesis filter, and the predicted LPC coefficient is used as a coefficient of the synthesis filter, thereby obtaining the synthesized high frequency band signal.

It can be seen from the above that, in the bandwidth extension method in this embodiment of the present invention, high frequency band energy is predicted by fully using a low frequency band parameter obtained by directly decoding a bitstream, a intermediate decoded parameter, or a low frequency band signal obtained by final decoding; a high frequency band excitation signal is adaptively predicted according to a low frequency band excitation signal, so that a high frequency band signal that is finally output is closer to an original high frequency band signal, thereby improving quality of the output signal.

Figure 4:
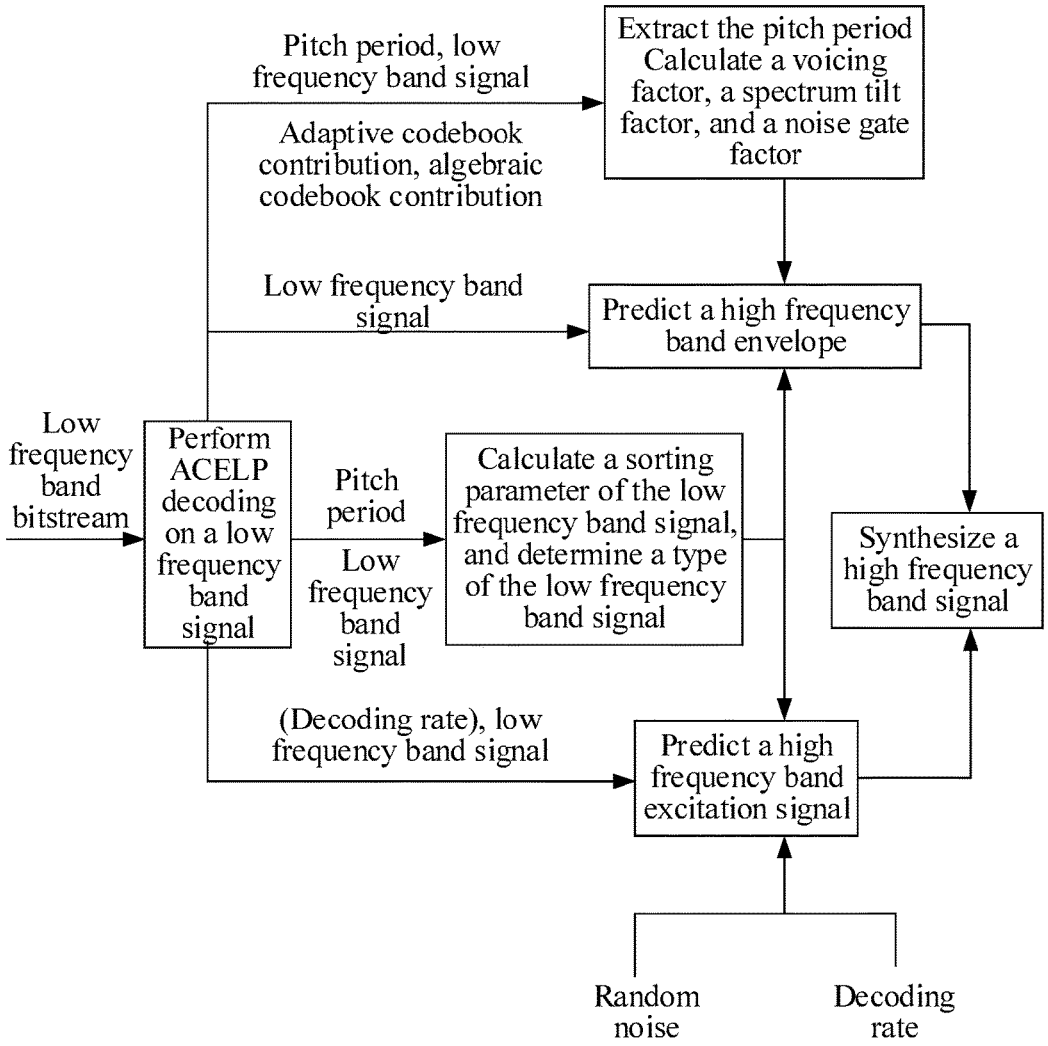
FIG. 4 is a block diagram of an implementation of a bandwidth extension method in a frequency domain according to an embodiment of the present invention.

As shown in FIG. 4, in a specific implementation process of performing bandwidth extension in a frequency domain:

First, a high frequency band LPC is predicted according to an LPC obtained by decoding.

Then, a high frequency band signal that needs to be extended is divided into M sub-bands, and high frequency band envelopes of the M sub-bands are predicted. For example, N frequency bands adjacent to the high frequency band signal are selected from a decoded low frequency band signal, energy or amplitude of the N frequency bands is calculated, and the high frequency band envelopes of the M sub-bands are predicted according to a size relationship between the energy or the amplitude of the N frequency bands. Herein, M and N are both preset values. For example, the high frequency band signal is divided into M=2 sub-bands, and N=2 or 4 sub-bands adjacent to the high frequency band signal are selected.

Further, the predicted high frequency band envelopes are corrected by using a classification parameter of the decoded low frequency band signal, a pitch period, an energy or amplitude ratio between high and low frequency band of the low frequency band signal, a voicing factor, and a noise gate factor. Herein, high frequency band and low frequency band may be divided differently for different low frequency band signals. For example, if bandwidth of a low frequency band signal is 6 kHz, 0 to 3 kHz and 3 to 6 kHz may be respectively used as low frequency band and high frequency band of the low frequency band signal, or 0 to 4 kHz and 4 to 6 kHz may be respectively used as low frequency band and high frequency band of the low frequency band signal.

A corrected high frequency band envelope is proportional to a minimum noise gate factor ng_min, proportional to a value fmerit of the classification parameter, proportional to an opposite number of a spectrum tilt factor tilt, and inversely proportional to the voicing factor voice_fac. In addition, for a signal whose pitch period pitch is stable, a corrected high frequency band envelope is proportional to the pitch period. In this case, larger high frequency band energy indicates a smaller spectrum tilt factor; a louder background noise indicates a larger noise gate factor; a stronger speech characteristic indicates a larger value of the classification parameter. For example, the corrected high frequency band envelope gain *=(1−tilt)*fmerit*(30+ng_min)*(1.6−voice_fac)*(pitch/100).

Next, when a decoding rate is greater than or equal to a given threshold, a frequency band, of a low frequency band signal, adjacent to the high frequency band signal is selected to predict a high frequency band excitation signal; or, when a decoding rate is less than a given threshold, a sub-band whose encoding quality is better is adaptively selected to predict a high frequency band excitation signal. Herein, the given threshold may be an empirical value.

Further, the predicted high frequency band excitation signal is weighted by using a random noise signal, and a weighted value is determined by the classification parameter of the low frequency band signal. A weight of the random noise signal is proportional to a size of a classification parameter of the low frequency band signal:

$$\mathrm{exc}[n]=\alpha'*\mathrm{exc}[n]+\beta'*\mathrm{random}[n],\ \text{where}\ \alpha'=\sqrt{1-\gamma*\mathrm{fmerit}},\ \beta'=\sqrt{\gamma*\mathrm{fmerit}}$$

where exc[n] is the predicted high frequency band excitation signal, random[n] is the random noise signal, α' is a weight of the predicted high frequency band excitation signal, β' is the weight of the random noise signal, γ is a value that is preset when the weight of the predicted high frequency band excitation signal is calculated to be α', and fmerit is a value of the classification parameter.

Finally, the high frequency band signal is synthesized by using the predicted high frequency band envelope and high frequency band excitation signal.

Herein, a synthesis process may be directly multiplying the high frequency band excitation signal of the frequency domain by the high frequency band envelope of the frequency domain, to obtain the synthesized high frequency band signal.

It can be seen from the above that, in the bandwidth extension method in this embodiment of the present invention, high frequency band energy is predicted by fully using a low frequency band parameter obtained by directly decoding a bitstream, a intermediate decoded parameter, or a low frequency band signal obtained by final decoding; a high frequency band excitation signal is adaptively predicted according to a low frequency band excitation signal, so that a high frequency band signal that is finally output is closer to an original high frequency band signal, thereby improving quality of the output signal.

Figure 5:
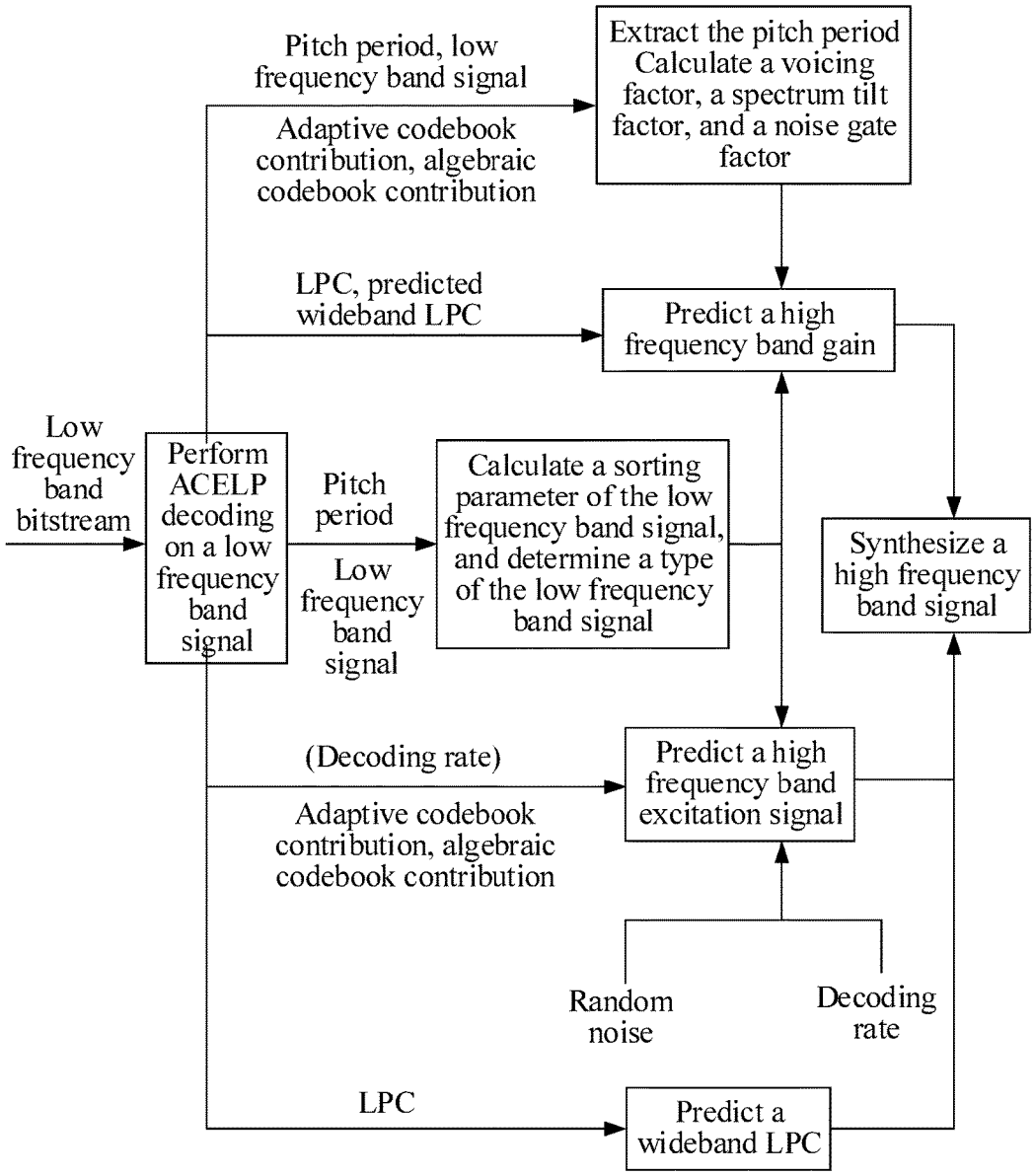
FIG. 5 is a block diagram of an implementation of a bandwidth extension method in a time domain according to an embodiment of the present invention.

As shown in FIG. 5, in a specific implementation process of performing bandwidth extension in a time domain:

First, a wideband LPC is predicted according to an LPC obtained by decoding.

Then, a high frequency band signal that needs to be extended is divided into M subframes, and high frequency band gains of the M subframes are predicted by using a relationship between the predicted wideband LPC and the LPC obtained by decoding.

Then, a high frequency band gain of a current subframe is predicted by using a low frequency band signal or a low frequency band excitation signal of the current subframe or a current frame.

Further, the predicted high frequency band gain is corrected by using a classification parameter of the decoded low frequency band signal, a pitch period, an energy or amplitude ratio between high and low frequency band of the low frequency band signal, a voicing factor, and a noise gate factor. A corrected high frequency band gain is proportional to a minimum noise gate factor ng_min, proportional to a value fmerit of the classification parameter, proportional to an opposite number of a spectrum tilt factor tilt, and inversely proportional to the voicing factor voice_fac. In addition, for a signal whose pitch period pitch is stable, a corrected high frequency band gain is proportional to the pitch period. In this case, larger high frequency band energy indicates a smaller spectrum tilt factor; a louder background noise indicates a larger noise gate factor; a stronger speech characteristic indicates a larger value of the classification parameter. For example, the corrected high frequency band gain gain *=(1−tilt)*fmerit*(30+ng_min)*(1.6−voice_fac)*(pitch/100), where tilt is the spectrum tilt factor, fmerit is the value of the classification parameter, ng_min is the minimum noise gate factor, voice_fac is the voicing factor, and pitch is the pitch period.

Next, when a decoding rate is greater than or equal to a given threshold, a frequency band, of the decoded low frequency band signal, adjacent to the high frequency band signal is selected to predict a high frequency band excitation signal; or, when a decoding rate is less than a given threshold, a frequency band whose encoding quality is better is adaptively selected to predict a high frequency band excitation signal. That is, a low frequency band excitation signal (an adaptive codebook contribution and an algebraic codebook contribution) with a frequency band adjacent to the high frequency band signal may be used as the high frequency band excitation signal.

Further, the predicted high frequency band excitation signal is weighted by using a random noise signal, and a weighted value is determined by the classification parameter of the low frequency band signal and a weighted value of the voicing factor.

Finally, the high frequency band signal is synthesized by using the predicted high frequency band gain and high frequency band excitation signal, and the predicted LPC.

Herein, a synthesis process may be using the high frequency band excitation signal of the time domain and the high frequency band gain of the time domain as inputs of a synthesis filter, and using the predicted LPC coefficient as a coefficient of the synthesis filter, thereby obtaining the synthesized high frequency band signal.

It can be seen from the above that, in the bandwidth extension method in this embodiment of the present invention, high frequency band energy is predicted by fully using a low frequency band parameter obtained by directly decoding a bitstream, a intermediate decoded parameter, or a low frequency band signal obtained by final decoding; a high frequency band excitation signal is adaptively predicted according to a low frequency band excitation signal, so that a high frequency band signal that is finally output is closer to an original high frequency band signal, thereby improving quality of the output signal.

Figure 6:
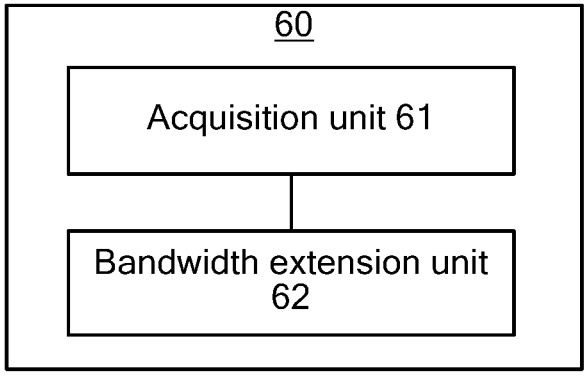
FIG. 6 is a schematic structural diagram of a bandwidth extension apparatus according to an embodiment of the present invention.

FIG. 6 to FIG. 11 show structural diagrams of a bandwidth extension apparatus according to an embodiment of the present invention. As shown in FIG. 6, a bandwidth extension apparatus 60 includes an acquisition unit 61 and a bandwidth extension unit 62. The acquisition unit 61 is configured to acquire a bandwidth extension parameter, where the bandwidth extension parameter includes one or more of the following parameters: a linear predictive coefficient (LPC), a line spectral frequency (LSF) parameter, a pitch period, a decoding rate, an adaptive codebook contribution, and an algebraic codebook contribution. The bandwidth extension unit 62 is configured to perform, according to the bandwidth extension parameter acquired by the acquisition unit 61, bandwidth extension on a decoded low frequency band signal, to obtain a high frequency band signal.

Figure 7:
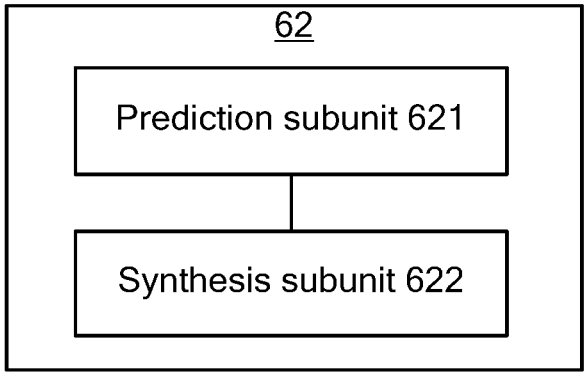
FIG. 7 is a schematic structural diagram of a bandwidth extension unit in a bandwidth extension apparatus according to an embodiment of the present invention.

Further, as shown in FIG. 7, the bandwidth extension unit 62 includes a prediction subunit 621 and a synthesis subunit 622. The prediction subunit 621 is configured to predict high frequency band energy and a high frequency band excitation signal according to the bandwidth extension parameter. The synthesis subunit 622 is configured to obtain the high frequency band signal according to the high frequency band energy and the high frequency band excitation signal. Specifically, the synthesis subunit 622 is configured to: synthesize the high frequency band energy and the high frequency band excitation signal, to obtain the high frequency band signal; or synthesize the high frequency band energy, the high frequency band excitation signal, and a predicted LPC, to obtain the high frequency band signal, where the predicted LPC includes a predicted high frequency band LPC or a predicted wideband LPC, and the predicted LPC is obtained based on the LPC.

Specifically, the high frequency band energy includes a high frequency band gain; and the prediction subunit 621 is configured to: predict the high frequency band gain according to the LPC; and adaptively predict the high frequency band excitation signal according to the LSF parameter, the adaptive codebook contribution, and the algebraic codebook contribution.

Alternatively, the high frequency band energy includes a high frequency band gain; and the prediction subunit 621 is configured to: predict the high frequency band gain according to the LPC; and adaptively predict the high frequency band excitation signal according to the decoding rate, the LSF parameter, the adaptive codebook contribution, and the algebraic codebook contribution.

Alternatively, the high frequency band energy includes a high frequency band gain; and the prediction subunit 621 is configured to: predict the high frequency band gain according to the LPC; and adaptively predict the high frequency band excitation signal according to the adaptive codebook contribution and the algebraic codebook contribution.

Alternatively, the high frequency band energy includes a high frequency band gain; and the prediction subunit 621 is configured to: predict the high frequency band gain according to the LPC; and adaptively predict the high frequency band excitation signal according to the decoding rate, the adaptive codebook contribution, and the algebraic codebook contribution.

Alternatively, the high frequency band energy includes a high frequency band envelope; and the prediction subunit 621 is configured to: predict the high frequency band envelope according to the decoded low frequency band signal; and predict the high frequency band excitation signal according to the decoded low frequency band signal or a low frequency band excitation signal, where the low frequency band excitation signal is the sum of the adaptive codebook contribution and the algebraic codebook contribution.

Alternatively, the high frequency band energy includes a high frequency band envelope; the prediction subunit 621 is configured to predict the high frequency band envelope according to the decoded low frequency band signal, and predict the high frequency band excitation signal according to the decoding rate and the decoded low frequency band signal.

Alternatively, the high frequency band energy includes a high frequency band envelope; the prediction subunit 621 is configured to predict the high frequency band envelope according to the decoded low frequency band signal, and predict the high frequency band excitation signal according to the decoding rate and the low frequency band excitation signal.

Figure 8:
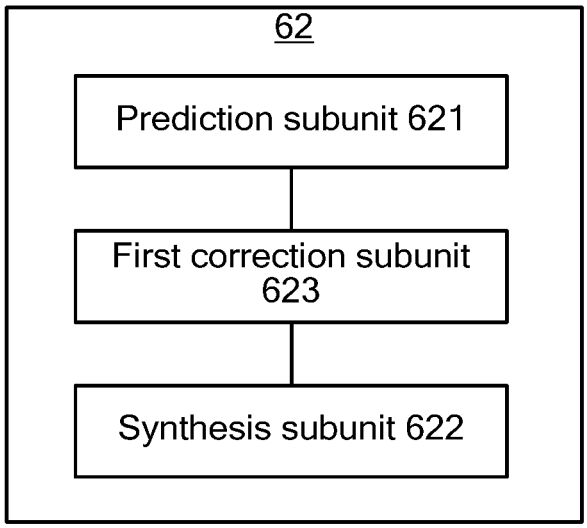
FIG. 8 is a schematic structural diagram of a bandwidth extension unit in a bandwidth extension apparatus according to another embodiment of the present invention.

In addition, the bandwidth extension unit 62 further includes a first correction subunit 623, as shown in FIG. 8. The first correction subunit 623 is configured to: after the high frequency band energy and the high frequency band excitation signal are predicted according to the bandwidth extension parameter, determine a first correction factor according to at least one of the bandwidth extension parameter and the decoded low frequency band signal; and correct the high frequency band energy according to the first correction factor, where the first correction factor includes one or more of the following parameters: a voicing factor, a noise gate factor, and a spectrum tilt factor.

Specifically, the first correction subunit 623 is configured to determine the first correction factor according to the pitch period, the adaptive codebook contribution, and the algebraic codebook contribution; and correct the high frequency band energy according to the first correction factor. Alternatively, the first correction subunit is specifically configured to: determine the first correction factor according to the decoded low frequency band signal; and correct the high frequency band energy according to the first correction factor. Alternatively, the first correction subunit is specifically configured to: determine the first correction factor according to the pitch period, the adaptive codebook contribution, the algebraic codebook contribution, and the decoded low frequency band signal; and correct the high frequency band energy according to the first correction factor.

Figure 9:
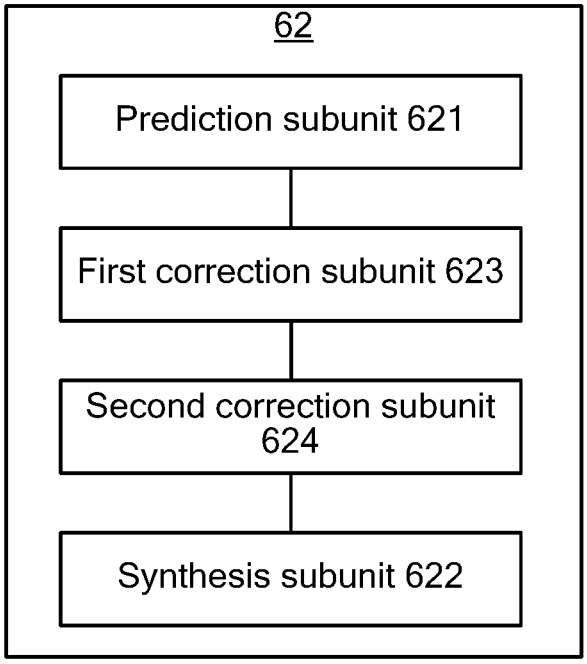
FIG. 9 is a schematic structural diagram of a bandwidth extension unit in a bandwidth extension apparatus according to another embodiment of the present invention.

In addition, the bandwidth extension unit 62 further includes a second correction subunit 624, as shown in FIG. 9, configured to correct the high frequency band energy according to the pitch period.

Figure 10:
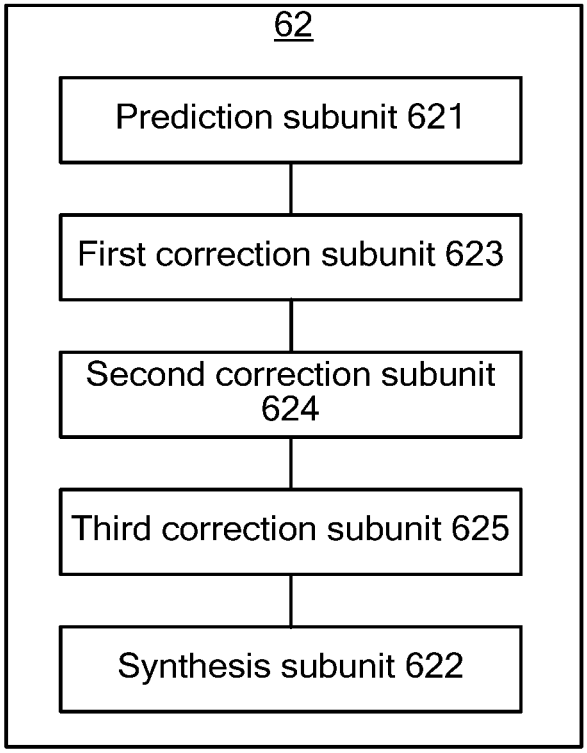
FIG. 10 is a schematic structural diagram of a bandwidth extension unit in a bandwidth extension apparatus according to another embodiment of the present invention.

In addition, the bandwidth extension unit 62 further includes a third correction subunit 625, as shown in FIG. 10, configured to determine a second correction factor according to at least one of the bandwidth extension parameter and the decoded low frequency band signal, where the second correction factor includes at least one of a classification parameter and a signal type; and correct the high frequency band energy and the high frequency band excitation signal according to the second correction factor.

Specifically, the third correction subunit 625 is configured to determine the second correction factor according to the bandwidth extension parameter; and correct the high frequency band energy and the high frequency band excitation signal according to the second correction factor. Alternatively, the third correction subunit 625 is configured to determine the second correction factor according to the decoded low frequency band signal; and correct the high frequency band energy and the high frequency band excitation signal according to the second correction factor. The third correction subunit 625 is configured to determine the second correction factor according to the bandwidth extension parameter and the decoded low frequency band signal; and correct the high frequency band energy and the high frequency band excitation signal according to the second correction factor.

Figure 11:
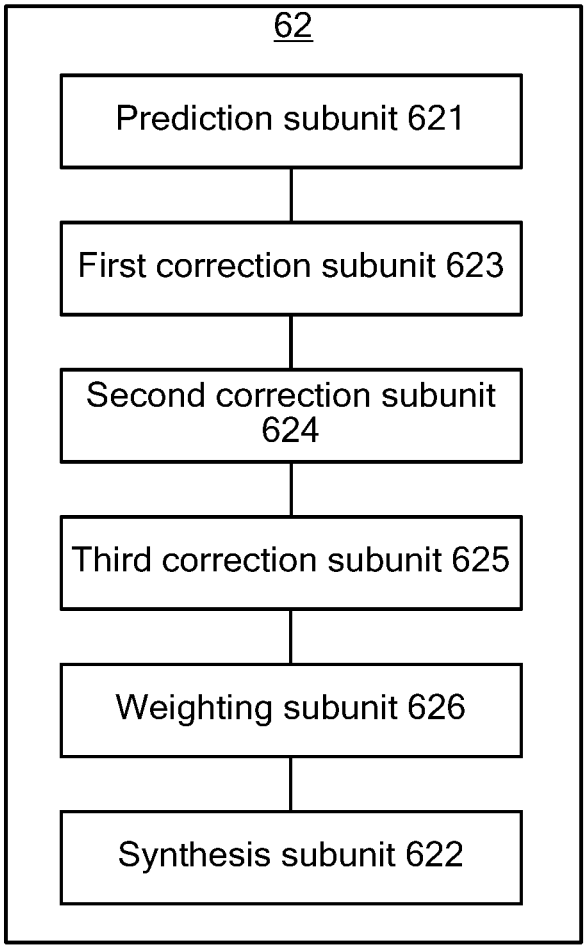
FIG. 11 is a schematic structural diagram of a bandwidth extension unit in a bandwidth extension apparatus according to another embodiment of the present invention.

Further, the bandwidth extension unit 62 further includes a weighting subunit 626, as shown in FIG. 11, configured to weight the predicted high frequency band excitation signal and a random noise signal, to obtain a final high frequency band excitation signal, where a weight of the weighting is determined according to a value of a classification parameter and/or a voicing factor of the decoded low frequency band signal.

In an embodiment of the present invention, the bandwidth extension apparatus 60 may further include a processor, where the processor is configured to control units included in the bandwidth extension apparatus.

It can be seen from the above that, the bandwidth extension apparatus in this embodiment of the present invention predicts high frequency band energy by fully using a low frequency band parameter obtained by directly decoding a bitstream, a intermediate decoded parameter, or a low frequency band signal obtained by final decoding; adaptively predicts a high frequency band excitation signal according to a low frequency band excitation signal, so that a high frequency band signal that is finally output is closer to an original high frequency band signal, thereby improving quality of the output signal.

Figure 12:
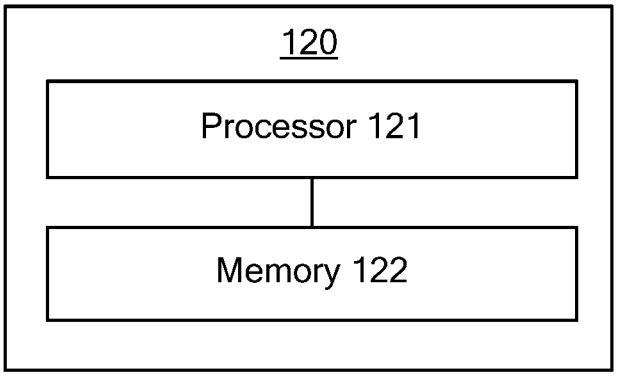
FIG. 12 is a schematic structural diagram of a decoder according to an embodiment of the present invention.

FIG. 12 shows a schematic structural diagram of a decoder 120 according to an embodiment of the present invention. The decoder 120 includes a processor 121 and a memory 122.

The processor 121 implements a bandwidth extension method in an embodiment of the present invention. That is, the processor 121 is configured to acquire a bandwidth extension parameter, where the bandwidth extension parameter includes one or more of the following parameters: a linear predictive coefficient (LPC), a line spectral frequency (LSF) parameter, a pitch period, a decoding rate, an adaptive codebook contribution, and an algebraic codebook contribution; and perform, according to the bandwidth extension parameter, bandwidth extension on a decoded low frequency band signal, to obtain a high frequency band signal. The memory 122 is configured to store instructions to be executed by the processor 121.

It should be understood that, a solution described in each claim of the present invention should also be considered as an embodiment, and is a feature in the claim and may be combined. For example, different branch steps performed after determining steps in the present invention may be used as different embodiments.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the some embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present invention essentially, or the part contributing to the prior art, or some of the technical solutions may be implemented in a form of a software product. The computer software product is stored in a storage medium, and includes some instructions for instructing a computer device (which may be a personal computer, a server, or a network device) to perform all or some of the steps of the methods described in the embodiments of the present invention. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

The invention claimed is:

1. A decoder implemented bandwidth extension method, comprising:

performing decoding operations on a bitstream encoded from an audio signal, wherein a low frequency band signal is generated via the decoding operations, and a collection of parameters is acquired via the decoding operations, and wherein the collection of parameters comprises linear prediction coefficients (LPC), a set of line spectral frequency (LSF) parameters, an adaptive codebook contribution, and an algebraic codebook contribution;

predicting a high frequency band gain according to the LPC;

selecting a signal with a frequency band from a low frequency band excitation signal as a high band excitation signal according to difference values between every two LSF parameters of the set of LSF parameters, wherein a decoding rate corresponding to the decoding operations is less than a given value, and wherein the low frequency band excitation signal is represented by a sum of the adaptive codebook contribution and the algebraic codebook contribution; and generating a high frequency band signal from the high frequency band excitation signal and the high frequency band gain.

2. The method according to claim 1, further comprising:

correcting the high frequency band gain according to a first correction factor, wherein the first correction factor comprises one or more of the following parameters: a voicing factor, a noise gate factor, and a spectrum tilt factor.

3. The method according to claim 2, wherein the first correction factor is determined according to the low frequency band signal generated via the decoding operations.

4. The method according to claim 2, further comprising:

correcting the high frequency band gain and the high frequency band excitation signal according to a second correction factor, wherein the second correction factor comprises of a classification parameter or a signal type, and the second correction factor is calculated according to the collection of parameters.

5. The method according to claim 2, wherein the high frequency band excitation signal is based on a weighted combination of the predicted high frequency band excitation signal and a random noise signal, wherein a weight of the weighted combination is determined according to a classification parameter or a voicing factor of the low frequency band signal.

6. The method according to claim 1, further comprising: correcting the high frequency band gain according to a pitch period acquired via the decoding operations.

7. The method according to claim 1, wherein the generation of the high frequency band signal comprises:

correcting the high frequency band excitation signal by using the predicted high-frequency gain, and filtering the corrected high frequency band excitation signal through an LPC synthesis filter to obtain the high frequency band signal.

8. The method according to claim 1, wherein predicting the high frequency band gain comprises:

computing an initial high frequency band gain according to the LPC; and correcting the initial high frequency band gain according to a first correction factor to obtain the high frequency band gain, wherein the first correction factor comprises one or more of the following parameters: a voicing factor, a noise gate factor, and a spectrum tilt factor.

9. The method according to claim 1, wherein selecting a signal with a frequency band from a low frequency band excitation signal as a high band excitation signal according to difference values between every two LSF parameters of the set of LSF parameters comprises:

calculating difference values between every two LSF parameters in the set of LSF parameters to obtain a group of difference values;

searching for a minimum difference value from the group of difference values;

determining a frequency bin corresponding to the minimum difference value; and selecting a frequency domain excitation signal from the low-frequency excitation signal as the high frequency band excitation signal according to the frequency bin.

10. A bandwidth extension apparatus having a processor coupled to a memory storing instructions, wherein the processor executes the instructions to:

perform decoding operations on a bitstream encoded from an audio signal, wherein a low frequency band signal is generated via the decoding operations, wherein a collection of parameters is acquired via the decoding operations, and wherein the collection of parameters comprises linear prediction coefficients (LPC), a set of line spectral frequency (LSF) parameters, an adaptive codebook contribution, and an algebraic codebook contribution;

predict a high frequency band gain according to the LPC;

select a signal with a frequency band from a low frequency band excitation signal as a high band excitation signal according to difference values between every two LSF parameters of the set of LSF parameters, wherein a decoding rate corresponding to the decoding operations is less than a given value, and the low frequency band excitation signal is represented by a sum of the adaptive codebook contribution and the algebraic codebook contribution; and generate a high frequency band signal from the high frequency band excitation signal and the high frequency band gain.

11. The apparatus according to claim 10, wherein the processor is further configured to:

correct the high frequency band gain according to a first correction factor, wherein the first correction factor comprises one or more of the following parameters: a voicing factor, a noise gate factor, and a spectrum tilt factor.

12. The apparatus according to claim 11, wherein the processor is configured to determine the first correction factor according to the low frequency band signal generated via the decoding operations.

13. The apparatus according to claim 11, wherein the processor is further configured to: correct the high frequency band gain and the high frequency band excitation signal according to a second correction factor, wherein the second correction factor comprises a classification parameter or a signal type, and the second correction factor is calculated according to the collection of parameters.

14. The apparatus according to claim 11, wherein the high frequency band excitation signal is based on a weighted combination of the predicted high frequency band excitation signal and a random noise signal, wherein a weight of the weighted combination is determined according to a classification parameter or a voicing factor of the low frequency band signal.

15. The apparatus according to claim 10, wherein the processor is further configured to correct the high frequency band gain according to a pitch period acquired via the decoding operations.

16. The apparatus according to claim 10, wherein the processor is configured to correct the high frequency band excitation signal by using the predicted high-frequency gain, and filtering the corrected high frequency band excitation signal through a LPC synthesis filter to obtain the high frequency band signal.

17. The apparatus according to claim 10, wherein the processor is configured to compute an initial high frequency band gain according to the LPC, and correct the initial high frequency band gain according to a first correction factor to obtain the high frequency band gain, wherein the first correction factor comprises one or more of the following parameters: a voicing factor, a noise gate factor, and a spectrum tilt factor.

18. The apparatus according to claim 10, wherein the processor is configured to:

calculate difference values between every two LSF parameters in the set of LSF parameters to obtain a group of difference values;

search for a minimum difference value from the group of difference values;

determine a frequency bin corresponding to the minimum difference value; and select a frequency domain excitation signal from the low-frequency excitation signal as the high frequency band excitation signal according to the frequency bin.

19. A non-transitory computer readable media containing computer instructions that, when executed by a processor, cause the processor to perform the steps of:

performing decoding operations on a bitstream encoded from an audio signal, wherein a low frequency band signal is generated via the decoding operations, wherein a collection of parameters is acquired via the decoding operations, and wherein the collection of parameters comprises linear prediction coefficients (LPC), a set of line spectral frequency (LSF) parameters, an adaptive codebook contribution, and an algebraic codebook contribution;

predicting a high frequency band gain according to the LPC;

selecting a signal with a frequency band from a low frequency band excitation signal as a high band excitation signal according to difference values between every two LSF parameters of the set of LSF parameters, wherein a decoding rate corresponding to the decoding operations is less than a given value, and the low frequency band excitation signal is represented by a sum of the adaptive codebook contribution and the algebraic codebook contribution; and generating a high frequency band signal from the high frequency band excitation signal and the high frequency band gain.

* * * * *